US012474123B2

(12) United States Patent
Le Mer

(10) Patent No.: US 12,474,123 B2
(45) Date of Patent: Nov. 18, 2025

(54) HEAT EXCHANGER

(71) Applicant: Sermeta, Morlaix (FR)

(72) Inventor: Joseph Le Mer, Plouezoch (FR)

(73) Assignee: Sermeta (FR)

( * ) Notice: Subject to any disclaimer, the term of this patent is extended or adjusted under 35 U.S.C. 154(b) by 178 days.

(21) Appl. No.: 18/578,991

(22) PCT Filed: Jul. 15, 2022

(86) PCT No.: PCT/EP2022/069914
§ 371 (c)(1),
(2) Date: Jan. 12, 2024

(87) PCT Pub. No.: WO2023/285680
PCT Pub. Date: Jan. 19, 2023

(65) Prior Publication Data

US 2024/0337448 A1 Oct. 10, 2024

(30) Foreign Application Priority Data

Jul. 16, 2021 (FR) ..... 2107688

(51) Int. Cl.
*F28D 7/12* (2006.01)
*F28D 7/02* (2006.01)
*F28F 1/02* (2006.01)

(52) U.S. Cl.
CPC ..... *F28D 7/024* (2013.01); *F28F 1/02* (2013.01)

(58) Field of Classification Search
CPC ..... F28D 7/024; F28F 1/02
(Continued)

(56) References Cited

U.S. PATENT DOCUMENTS

| | | | |
|---|---|---|---|
| 7,909,005 | B2 | 3/2011 | Le Mer et al. |
| 2012/0312513 | A1 | 12/2012 | Le Mer et al. |
| 2015/0153067 | A1 | 6/2015 | Le Mer |

FOREIGN PATENT DOCUMENTS

| | | | |
|---|---|---|---|
| EP | 3141838 | B1 | 5/2020 |
| FR | 2700608 | A1 | 7/1994 |

(Continued)

OTHER PUBLICATIONS

French Preliminary Search Report for Application No. 2107688 dated Mar. 8, 2022, 2 pages. [See p. 1, categorizing the cited references].

(Continued)

*Primary Examiner* — Davis D Hwu
(74) *Attorney, Agent, or Firm* — Lerner David LLP

(57) ABSTRACT

The present invention relates to a heat exchanger (1'), comprising: —a gas-tight casing (2), —at least one tube (4) made from a good thermally conducting material and inside which a fluid to be heated can circulate, this tube (4) being helically wound so as to form a helical winding (40) having a longitudinal axis (X-X') which is arranged inside said casing (2), —means for conveying and/or for producing hot gases inside said casing (2), such as a burner (3), so as to define a combustion chamber (26) therein, this helical winding (40) being arranged so as to form a gap (45) between two adjacent turns, said at least one tube (4) having a front face (41) and a rear face (42) which are opposing, a bottom side (43) oriented towards the longitudinal axis (X-X') and a top side (44) oriented towards the casing (2), said front face (41) and said rear face (42) of the tube (4) being planar or substantially planar and being located on either side of the gap (45). This heat exchanger is noteworthy in that said at least one tube (4) has, on the front face (41) thereof and/or the rear face (42) thereof, a shoulder (46) which extends from the bottom side (43) of the tube towards the top side
(Continued)

(44) thereof, over part of the height (H1) of the straight section of this tube (4) and also over the whole, or virtually the whole, length of this tube (4).

11 Claims, 7 Drawing Sheets

(58) Field of Classification Search
USPC ..... 165/156
See application file for complete search history.

(56) References Cited

FOREIGN PATENT DOCUMENTS

| | | | |
|---|---|---|---|
| JP | 2004532966 A | * | 10/2004 |
| JP | 2016033440 A | * | 3/2016 |

OTHER PUBLICATIONS

International Search Report for Application No. PCT/EP2022/069914 mailed Aug. 22, 2022, 2 pages.

* cited by examiner

HEAT EXCHANGER

CROSS-REFERENCE TO RELATED APPLICATIONS

The present application is a national phase entry under 35 U.S.C § 371 of International Application No. PCT/EP2022/069914 filed Jul. 15, 2022, which claims priority from French Application No. 2107688 filed Jul. 16, 2021, all of which are hereby incorporated herein by reference.

FIELD OF THE INVENTION

The invention lies in the field of heat exchangers, in particular those used to produce domestic hot water or water for a heating network.

The invention concerns more particularly a heat exchanger comprising a casing, means for supplying and/or producing hot gases inside this casing to define a combustion chamber therein and at least one helically tube wound, disposed in this combustion chamber and inside which a fluid to be heated, such as water, circulates.

STATE OF THE ART

Such a heat exchanger is already known in the state of the art. In this type of exchanger, the helical winding of the tube is arranged so as to provide a small interstice between its adjacent turns. Hot gases, produced or brought into the winding, pass through the interstices, from inside to outside and are then discharged to the outside of the heat exchanger by a sleeve for discharging burnt gases, provided for this purpose.

When the hot gases pass through these interstices, they heat the walls of the turns of the tube, located on either side of the interstice and in doing so, they also heat the fluid circulating in this tube.

However, it is observed, particularly in the case where the tube has an oblong cross section with planar or substantially planar front face and rear face, that the interstice between two neighboring turns can get clogged and even obstruct over time, because slag, that is to say soot or unburned particles carried by hot gases, are deposited there.

This total or partial obstruction of some interstices has the effect of creating an increase in the pressure of the gases circulating inside the combustion chamber, which requires increasing the speed of the fan that brings the air/fuel mixture into the burner or hot air into the chamber and therefore increasing the electrical consumption of this fan.

This obstruction of some interstices also has the effect of reducing the heat exchange surface between the fluid to be heated and the hot gases and therefore generating a heating of the fluid that circulates in the tube, which is not homogeneous over the entire length of the latter and of leading to a drop in efficiency of the heat exchanger.

In addition, the efficiency of the exchanger deteriorates over time as the interstices get clogged.

Finally, because of this obstruction, it is also necessary to regularly clean these interstices. This maintenance operation is labor-intensive and time-consuming.

A heating apparatus equipped with a door having an integrated burner is already known from document US 2015/0153067. This apparatus comprises a tube inside which a fluid to be heated can circulate. This tube is helically wound so as to form a helical winding whose turns are spaced from each other by an interstice allowing the passage of hot gases produced by the burner. These interstices are calibrated using embossed points formed on one of the planar faces of the tube as can be seen in the figures of this document.

However, this document does not describe or suggest the fact of making a soot and slag recovery shoulder, formed on the front and/or rear face of this tube over part of the height of the straight section of this tube from the intrados side of the tube and over the entire length of the tube or almost the entire length of the tube.

A heat exchanger comprising a tube helically wound and disposed inside an enclosure and around a burner is also known from document EP 3 141 838. The interstices between the turns are calibrated by a comb provided with teeth, disposed on the extrados side of the tube.

This tube also has, on the intrados side, a plurality of wings intended to increase the contact surface and the heat transfer between the hot gases produced by the burner and the tube and therefore the fluid to be heated circulating therein. These wings are formed at the intrados ends of the tube (on its short sides).

This document does not describe the fact of having a shoulder on the front and/or rear face of the tube, in order to recover the soot and the slag.

DISCLOSURE OF THE INVENTION

One aim of the invention is therefore to propose a heat exchanger making it possible to solve the aforementioned problems and in particular to limit the clogging of the interstices between two neighboring turns of the tube of this exchanger.

For this purpose, the invention relates to a heat exchanger comprising:

- a gas-tight casing, provided with a sleeve for discharging burnt gases,
- at least one tube, made of a thermally good conductive material and inside which a fluid to be heated, such as water, can circulate, this tube being helically wound so as to form a helical winding with a longitudinal axis X-X', this helical winding being disposed inside said casing,
- means for supplying and/or producing hot gases inside said casing, such as a gas or oil burner, so as to define a combustion chamber therein, this helical winding being arranged so as to provide an interstice between two adjacent turns, said at least one tube having a front face and a rear face opposite to each other, an intrados side oriented towards the longitudinal axis X-X' and an opposite extrados side oriented towards the casing, said front face and said rear face of the tube being planar or substantially planar and located on either side of the interstice.

In accordance with the invention, said at least one tube has a shoulder on its front face and/or its rear face, this shoulder extends from the intrados side of the tube in the direction of its extrados side, over part of the height of the straight section of this tube and this shoulder also extends either over the entire length of said at least one tube located in said combustion chamber, or over the entire length of said at least one tube located in said combustion chamber with the exception of the first or last turn of the helical winding, and each interstice between two neighboring turns is calibrated either using a tooth of a comb introduced into the interstice between two turns, on the extrados side of the tube, or using several protruding elements, such as bosses, formed on the front face and/or on the rear face of said at least one tube, each protruding element formed on a turn of the tube bearing respectively against the rear face and/or the front face of the adjacent turn, so that the shoulder makes it possible to recover the soot and the slag entrained in the hot gases that pass through the interstices.

This shoulder makes it possible to recover the soot or the slag resulting from the combustion of the gases by the burner, while keeping the interstice between two neighboring turns clear. The hot gases can thus continue to pass through this interstice and heat the water circulating in the helical winding.

This shoulder therefore makes it possible to delay the speed of clogging of the turns, to limit the pressure increase in the combustion chamber, not to generate electrical overconsumption of the exchanger, to maintain the efficiency of the exchanger and to delay and space out the maintenance/cleaning interventions carried out on the heat exchanger tube.

According to other advantageous and non-limiting characteristics of the invention, taken alone or in combination:

- the shoulder extends over a height, measured from the intrados, which measures up to approximately one third of the height of the straight section of the tube.
- the gap between two neighboring turns, measured where the shoulder(s) are located, is wider than the gap between two neighboring turns, measured where there is no shoulder.
- a discoid deflector is mounted inside the helical winding in a gas-tight manner, this discoid deflector provides inside the casing, a condensation chamber which extends between said discoid deflector and the bottom of the casing and a combustion chamber which extends between said discoid deflector and a facade of the casing on which a door carrying said hot gas supply and/or production means is mounted and the shoulder is formed exclusively on the tube(s) or the tube portion which is positioned in the combustion chamber.
- the interstice between the adjacent turns is calibrated using several protruding elements, such as bosses, formed on the front face and/or on the rear face of said at least one tube, each protruding element formed on a turn of the tube bearing respectively against the rear face and/or the front face of the adjacent turn and in that each protruding element is formed on the part of the front face and/or of the rear face which does not comprise the shoulder.
- the interstice between the adjacent turns is calibrated using several protruding elements, such as bosses, formed on the front face or on the rear face of said at least one tube, in that the protruding elements and the shoulder are formed on opposite faces of the tube and in that the protruding elements are bearing against the portion of the face of the tube that does not comprise the shoulder.
- said tube is hydroformed.

DESCRIPTION OF THE FIGURES

Other characteristics, aims and advantages of the invention will emerge from the following description, which is purely illustrative and not limiting, and which should be read in relation to the appended drawings in which.

DETAILED DESCRIPTION OF THE INVENTION

Figure 1:
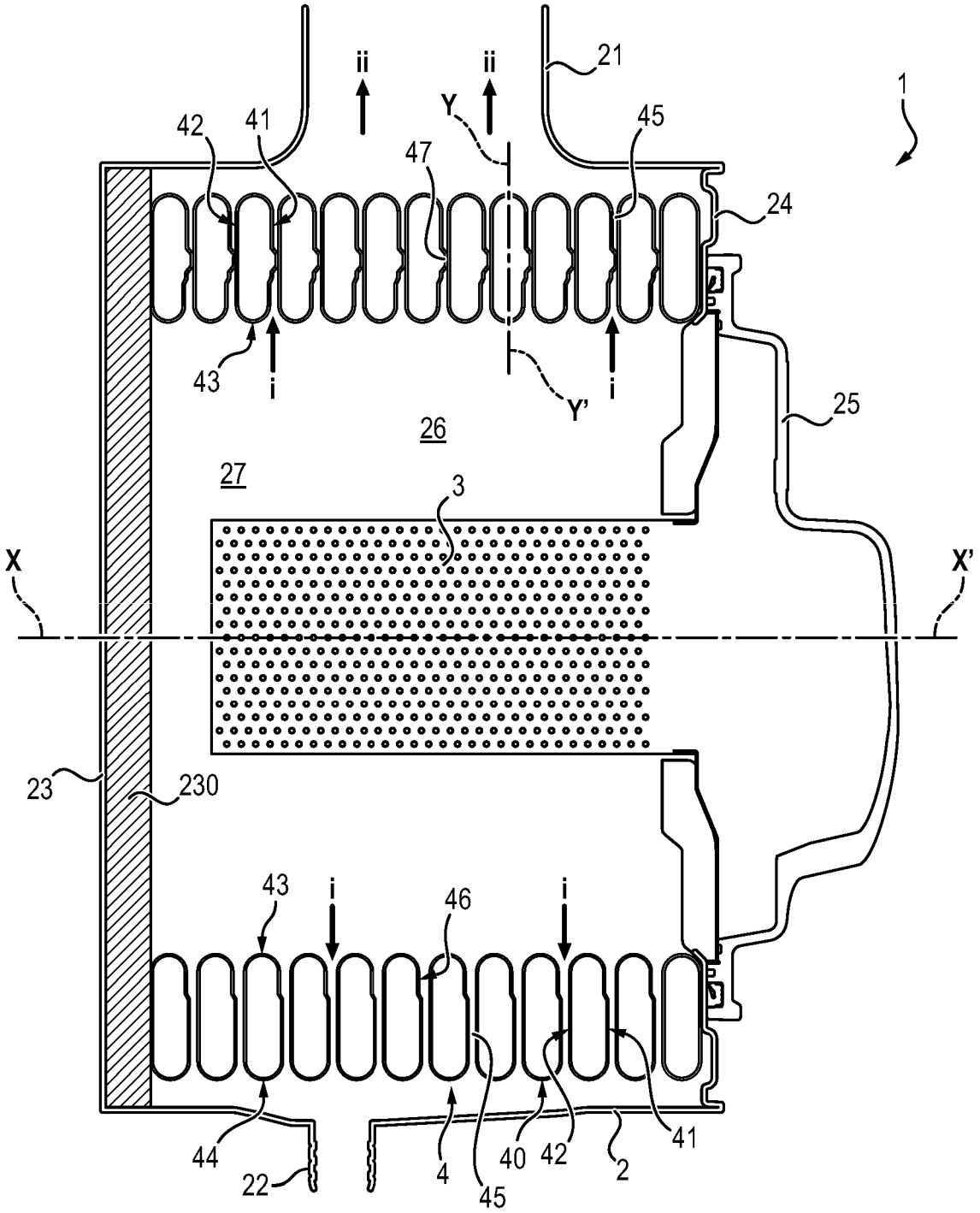
FIG. 1 represents a longitudinal sectional view of a heat exchanger in accordance with the invention, in which there is only one combustion chamber.

A first embodiment of the invention will now be described with reference to FIG. 1, which represents a heat exchanger 1 comprising only a combustion chamber. In this figure, the heat exchanger is represented in its normal position of use.

This heat exchanger 1 comprises a casing 2, means for supplying and/or producing hot gases inside said casing and at least one tube 4, inside which the fluid to be heated circulates, in particular water. A pump not visible in the figures ensures this water circulation.

The casing 2 has a general tubular shape and extends along a longitudinal axis X-X'. In a known manner it has, at its upper part, a sleeve 21 for discharging burnt gases and, at its lower part, an outlet orifice connected to a duct 22 for discharging condensates.

The casing 2 is closed at its rear end by a bottom 23, equipped on its inner face with a disk 230 made of thermally insulating material.

A facade 24 is fixed to the front of the casing 2. It comprises a central opening, able to be obturated by a door 25.

The tube 4 is made of a thermally good conductive material, such as metal. It is helically wound on itself, so as to form a helical winding 40 and it is disposed inside the casing 2 so that its longitudinal axis X-X' is coincident with the longitudinal axis X-X' of the casing 2.

The hot gas production means are preferably a burner 3, for example a gas or oil burner. This burner 3 is preferably tubular in shape, and it is disposed inside the casing 2 and inside the winding 40, so that its longitudinal axis X-X' is coincident with the longitudinal axis X-X' of the casing 2.

The burner 3 is fixed on the inner face of the door 25.

The hot gas supply means (not represented in the figures) comprise a burner disposed outside the exchanger and a fan fixed on the door 25 to introduce the hot gases inside the casing 2, in the helical winding 40.

The space which extends inside the winding 40 thus constitutes a combustion chamber 26.

The tube 4 has two ends forming an inlet mouth and an outlet mouth, from which the fluid to be heated is respectively introduced and extracted. One of these mouths 400 is visible in FIG. 2.

The tube 4 has an oblong straight section, which can be oval or rectangular or even rectangular with short sides which can be protruding and curved (as represented in the figures) or even be protruding and V-shaped.

The tube 4 thus has a front face 41 and a rear face 42 opposite to each other.

Conventionally, in the remainder of the description and the claims, the term "front face" designates the face turned towards the front of the exchanger, that is to say towards the facade 24, while the term "rear face" designates the face turned towards the back of the exchanger, that is to say towards the bottom 23.

Furthermore, the tube 4 has an intrados side 43 oriented towards the axis X-X' and towards the combustion chamber 26 (or towards the burner 3 when the latter is present), and an opposite extrados side 44 oriented towards the casing 2. These intrados 43 and extrados 44 sides correspond to the short sides of the tube 4.

Preferably and as represented in the figures, the front 41 and rear 42 faces are planar and parallel to each other. However, depending on the shape of the straight section of the tube 4, these front 41 and rear 42 faces could not be strictly planar but substantially planar (for example slightly curved).

Preferably, and in order to simplify the assembly of the winding 40 between the facade 24 and the bottom 23 or the disk 230, the winding of the tube 4 is carried out so that the major axis Y-Y' of the straight section of the tube is perpendicular to the longitudinal axis X-X' of the helical winding 40. However, this major axis Y-Y' could also be slightly inclined relative to the longitudinal axis X-X' of the helical winding 40 without departing from the scope of the invention.

Figure 3:
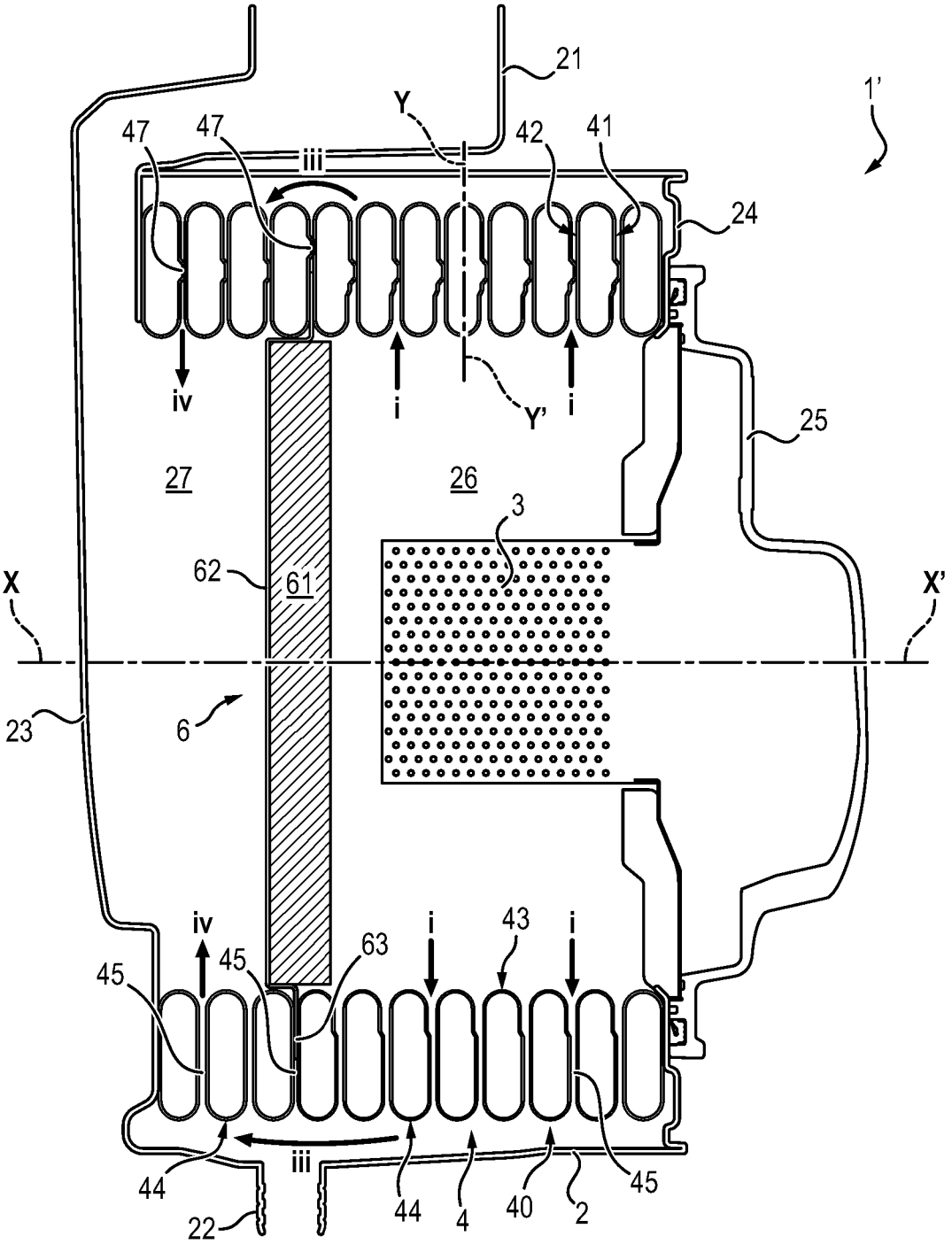
FIG. 3 is a longitudinal sectional view of a condensation heat exchanger in accordance with the invention.

The helical winding 40 has a series of neighboring turns and there is an interstice 45 between two neighboring turns, whose value is calibrated as will be detailed later. Within this winding 40, the front face 41 and the rear face 42 of the tube 4 are located on either side of the interstice 45 as seen in FIGS. 1 and 3.

The hot gases leave the combustion chamber 26 by passing through the interstices 45, from inside to outside, as symbolized by the arrows i. In doing so, they heat the walls of the tube 4 and in particular the front faces 41 and 42 and therefore the water circulating in this tube. The gases are then discharged to the outside through the sleeve 21, (see arrows ii).

Figure 2:
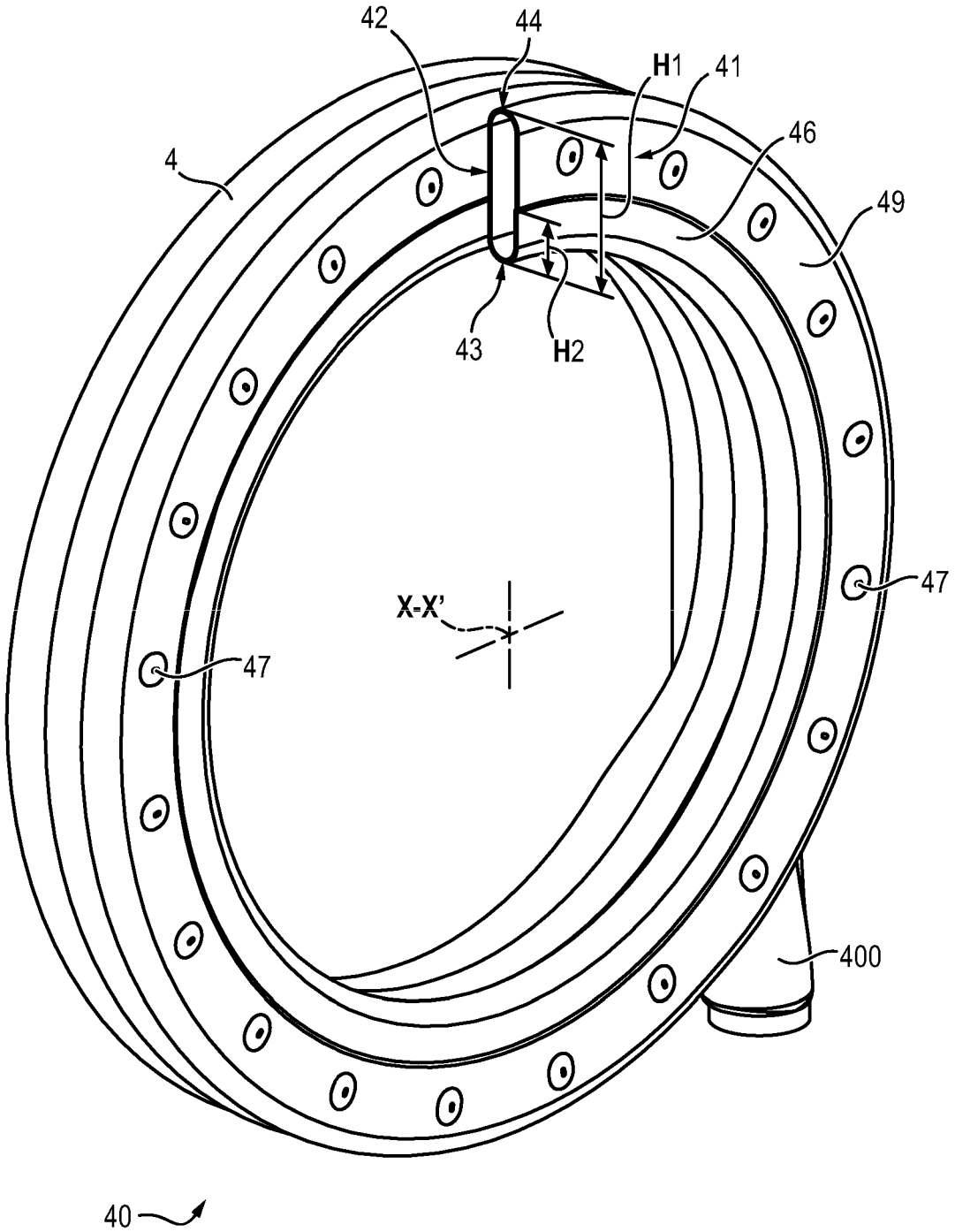
FIG. 2 is a perspective view of a part of a heat exchanger tube in accordance with the invention.
Figure 5:
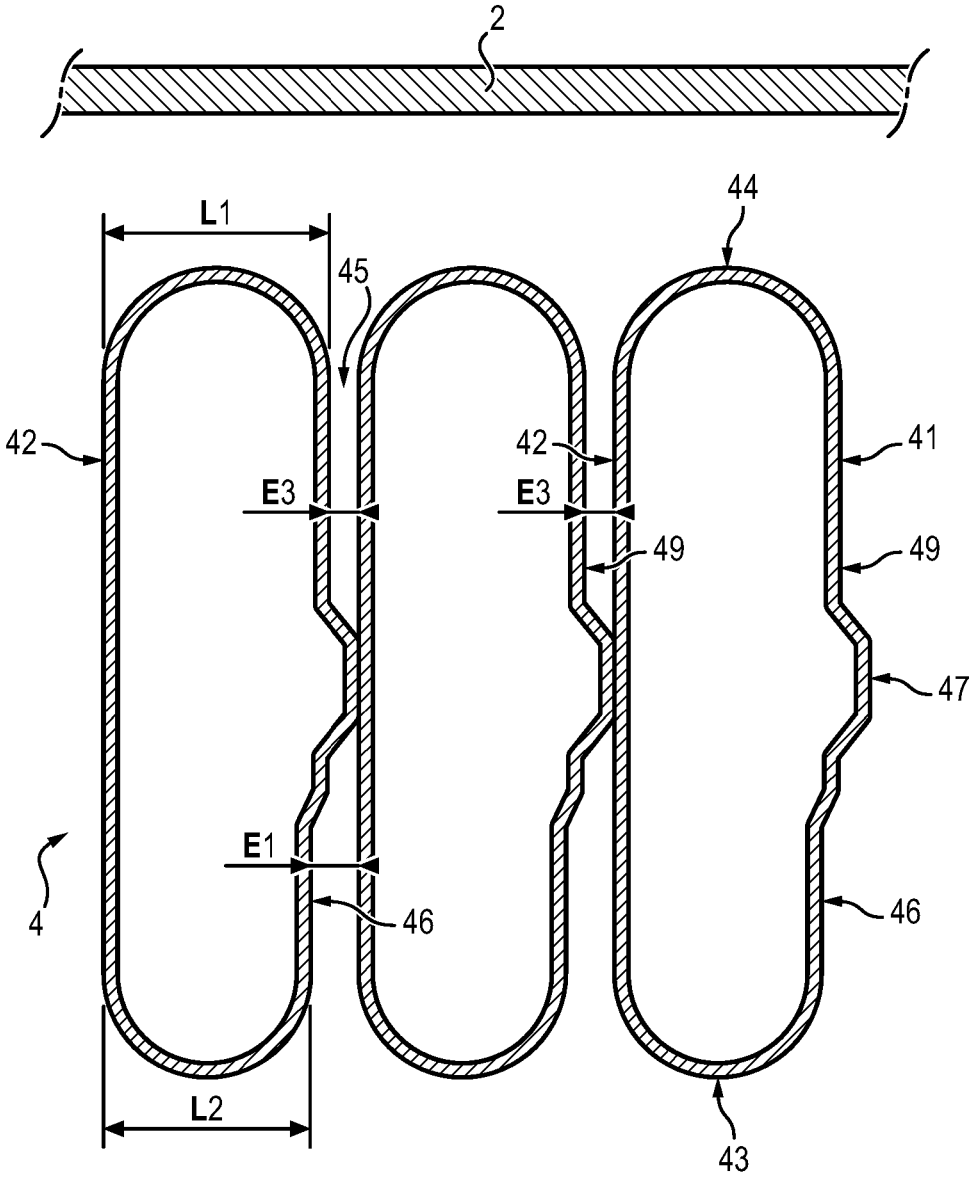
FIG. 5 is a detailed view of a cross section of three turns of the tube in accordance with the invention, the section being made at the level of the bosses.
Figure 6:
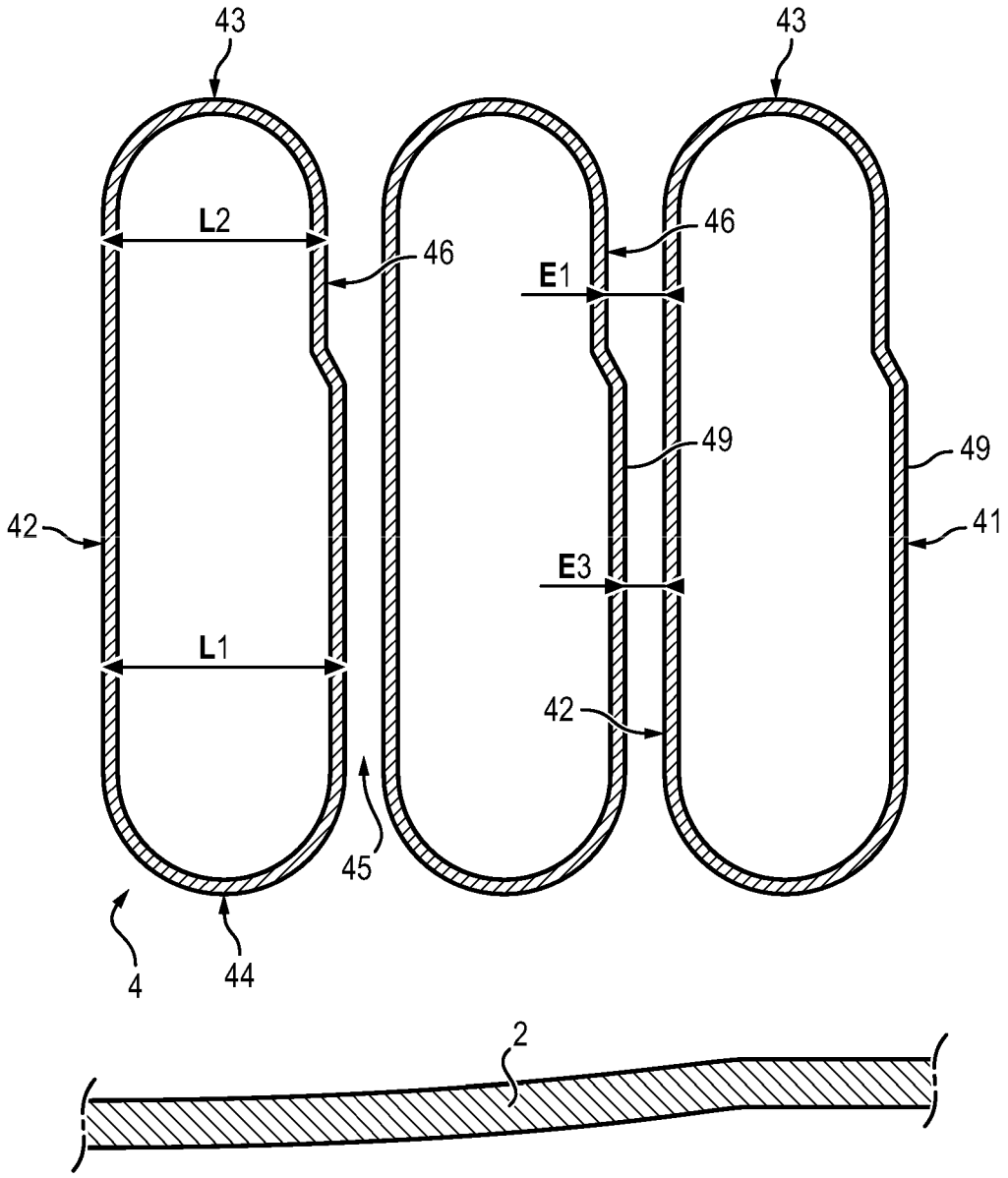
FIG. 6 is a detailed view of a cross section of three turns of the tube in accordance with the invention, the section being made at a point of the tube free of bosses.

In accordance with the invention, and as better seen in FIGS. 2, 5 and 6, the tube 4 has on its front face 41 and/or its rear face 42, a shoulder 46. This shoulder 46 extends from the intrados side 43 in the direction of the extrados side 44 over part of the height H1 of the straight section of the tube 4.

In FIG. 2, it can be seen that this shoulder 46 extends over a height H2 (measured from the intrados 43) smaller than H1. In other words, and as can be seen in FIGS. 5 and 6, the presence of the shoulder 46 means that the external width L2 of the cross section of the tube 4 taken at the level of the shoulder 46 is smaller than the external width L1 of the cross section of the tube 4 taken in the part of the tube where there is no shoulder 46.

Preferably, the height H2 measures up to approximately a third of the height H1.

The shoulder 46 can extend over the entire length of the tube 4. Preferably, and as can be seen in FIG. 2, this shoulder 46 is continuous.

However, preferably, it may also not extend over the entirety of this length, (but over almost its entirety) in particular not to extend over the first and/or the last turn of the winding 40, in order to simplify the mounting of this winding in the casing 2. Thus for example in FIG. 1, it can be seen that the first turn of the winding applied against the facade 24 does not have this shoulder 46. It could be the same on the last turn of the winding applied against the bottom 23 and the plate 230, in the case where the shoulder 46 is provided on the rear face 42.

Figure 7:
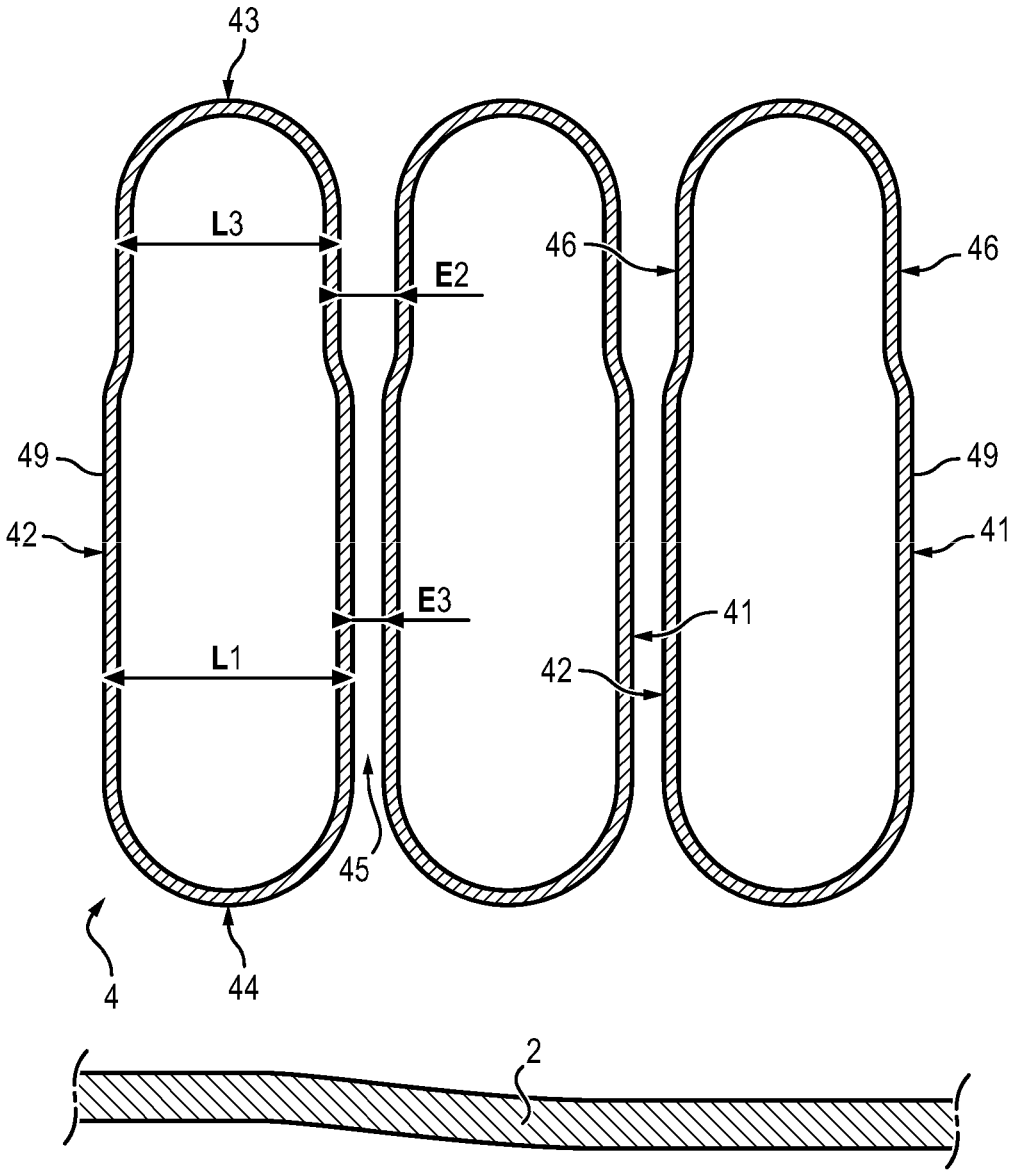
FIG. 7 is a detailed view of a cross section of three turns of the tube in accordance with another embodiment of the invention.

It could also be envisaged to provide for a shoulder 46 on the front face 41 and another shoulder 46 on the rear face 42 of the tube 4, as represented in FIG. 7. In this case, the external width of the cross section of the tube 4 taken at the level of the shoulders 46 is referenced L3, with L3 smaller than the width L1.

The shoulder 46 makes it possible to create a housing for recovering the soot and the slag which are entrained in the hot gases that pass through the interstices 45. The gap (or the width) between two neighboring turns, measured at the level of this shoulder 46 is referenced E1 when there is a shoulder 46 only on the front face 41 (see FIGS. 5 and 6) or only on the rear face 42 and is referenced E2 when there is a shoulder 46 on the front face 41 and a shoulder 46 on the rear face 42 (see FIG. 7).

This gap E1, E2 is therefore wider than the gap (or the width) E3 between two neighboring turns, measured where there is no shoulder 46, which allows trapping the slag in the shoulder 46 and leaving space for the passage of hot gases. The winding 40 therefore gets clogged less quickly, which makes it possible to reduce the frequency of cleaning operations.

The interstices 45 between two neighboring turns are advantageously calibrated so as to be all identical and thus so that the hot gas streams circulating therein are homogeneous and so that the heating of the fluid is even over the entire length of the tube.

Figure 4:
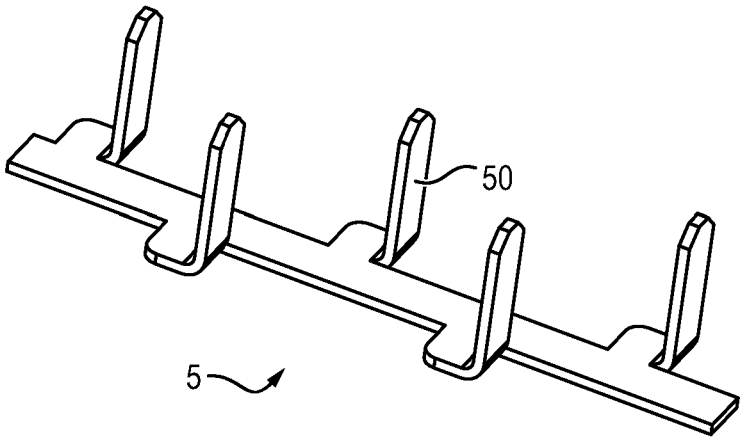
FIG. 4 is a perspective view of a comb.

According to a first alternative embodiment of the invention, the interstices 45 can be calibrated using one or more combs 5, such as the one represented for example in FIG. 4.

This comb 5 has a plurality of teeth 50 parallel to each other. This comb 5 is disposed relative to the winding 40, so that each of its teeth 50 is introduced into an interstice 45, on the extrados side 44 of the tube 4, in order to calibrate this interstice 45. Each tooth 50 is thus in contact with the front face 41 of a turn of the tube 4 and with the rear face 42 of the neighboring turn of the tube 4. Preferably, the teeth 50 do not extend to the level of the shoulder 46.

According to a second alternative embodiment of the invention, the interstices 45 can be calibrated using protruding elements, such as bosses 47 (corrugations) formed on the front face 41 of the tube 4, (as represented in FIGS. 1, 2 and 5) or on the rear face 42 (not visible in the figures). These bosses are preferably uniformly distributed over the entire length of the tube to obtain interstices 45 of a constant width.

Each protruding element formed on the front face 41 and/or on the rear face 42 of the tube 4 is bearing respectively against the rear face 42 and/or the front face 41 of the adjacent turn.

In the case where the bosses 47 and the shoulder 46 are made on the same front or rear face of the tube 4, for example on the front face 41 as represented in FIG. 2, then the bosses 47 are advantageously made on the portion referenced 49 of the face of the tube which does not comprise the shoulder 46, (see also FIG. 5).

In the case where the protruding elements (such as the bosses 47) and the shoulder 46 are made on opposite faces of the tube 4 (for example the shoulder 46 on the front face 41 and the protruding elements on the rear face 42 or the opposite), then the protruding elements are bearing against the portion 49 of the face of the tube which does not comprise the shoulder 46.

A second embodiment of the heat exchanger in accordance with the invention will now be described in relation to FIG. 3. In the latter, a condensation heat exchanger which bears the general reference 1' can be seen.

The elements identical to those described in relation to the heat exchanger 1 bear the same numerical references and will not be described again in detail.

This exchanger 1' differs from the exchanger 1, in that it comprises a discoid deflector 6, disposed inside the helical winding 40 of the tube 4, perpendicularly to the axis X-X', so as to provide inside the casing 2, on the one hand the combustion chamber 26 which extends between the door 25 and this deflector 6 and where the hot gases are produced or brought, and on the other hand a condensation chamber 27 which extends between the deflector 6 and the bottom 23 of the casing 2.

In this case, it will be noted that the gas discharge sleeve 21 is connected to the condensation chamber 27.

The deflector 6 comprises a disk 61 made of thermally insulating material, carried by a thin sheet metal frame 62, provided with a radial peripheral flange 63.

The deflector 6 is mounted inside the winding 40 of the tube 4, so that its flange 63 is inserted and positioned in a gas-tight manner, in the interstice 45 existing between the last turn of the tube 4 located in the combustion chamber 26 and the first turn of the tube 4 located in the condensation chamber 27.

Preferably, the shoulder 46 is formed only on the turns of the tube 4 located in the combustion chamber 26 and not on the turns of the tube located in the condensation chamber 27.

Indeed, as mentioned previously, the hot gases produced by the burner 3 leave the combustion chamber 26 by passing through the interstices 45 provided in the turns of the tube 4 located in this combustion chamber 26, (see the arrows i) and the slag is trapped in the shoulder 46. Then, the hot gases abut against the casing 2 and are guided towards the extrados side 44 of the turns of the tube 4 located in the condensation chamber 27 (see arrows iii). These hot gases then pass through the interstices 45 formed between the turns, this time from outside to inside, in the direction of the condensation chamber 27 (see arrows iv). These hot gases then no longer contain slag, so that the shoulder 46 is not necessary.

In the two embodiments which have just been described, the heat exchanger 1 or 1' comprises a single helically wound tube 4. In the case of the condensation heat exchanger 1', part of the turns of the single tube 4 extends into the combustion chamber 26 and the other part of the turns extends into the condensation chamber 27.

However, it would also be possible to have several tubes 4, each helically wound and disposed side by side, so that their respective longitudinal axes X-X' are coaxial. In this case, the different tubes 4 are connected to each other by manifolds.

In the particular case of the condensation heat exchanger 1', it is possible to have one or more tubes 4 in the combustion chamber 26 and one or more tubes 4 in the condensation chamber 27.

The tube 4 can be manufactured by different methods. Two non-limiting examples of manufacturing methods are given below.

It can for example be obtained by extrusion of metal, for example by extrusion of aluminum.

Advantageously, it can also be obtained by hydroforming.

It is possible to refer to this subject for example in patent FR 2700608 of the Applicant.

Such a method has the advantage of being able to vary the profile of the section of the tube 4 throughout the helical winding 40 and in particular of forming the shoulder 46 only over a certain part of the length of the tube 4. Particularly, this method makes it possible to create the shoulder 46 only on the turns located in the combustion chamber 26, in the case of the condensation heat exchanger 1'.

In addition, this method also makes it possible to have a tube whose faces of the first turn and of the last turn are planar, which makes it possible to simplify the design of the bottom and of the facade of the exchanger.

The invention claimed is:

1. A heat exchanger comprising:

a gas-tight casing, provided with a sleeve for discharging burnt gases, at least one tube, made of a thermally good conductive material and inside which a fluid to be heated can circulate, the at least one tube being helically wound so as to form a helical winding with a longitudinal axis and a plurality of adjacent turns, the helical winding being disposed inside the gas-tight casing, means for supplying and/or producing hot gases inside the casing, so as to define a combustion chamber inside the casing, the helical winding being arranged so as to provide an interstice between two adjacent turns, the at least one tube having a straight section, a front face and a rear face opposite to each other, an intrados side oriented towards the longitudinal axis and an opposite extrados side oriented towards the casing, the front face and the rear face of the tube being planar or substantially planar and being located on either side of the interstice, wherein the at least one tube has a shoulder on the front face and/or the rear face, wherein the shoulder extends from the intrados side of the tube in the direction of the extrados side of the tube, over part of a height of the straight section of the tube, wherein the shoulder also extends either over an entire length of the at least one tube located in the combustion chamber, or over the entire length of the at least one tube located in the combustion chamber with the exception of a first or a last turn of the helical winding, wherein each interstice between two adjacent turns is calibrated either using a tooth of a comb introduced into the interstice between two turns, on the extrados side of the tube, or using several protruding elements, formed on the front face and/or on the rear face of the at least one tube, each protruding element formed on one turn of the tube bearing respectively against the rear face and/or the front face of the adjacent turn, so that the shoulder makes possible to recover soot and slag entrained in the hot gases that pass through the interstices.

2. The heat exchanger according to claim 1, wherein the shoulder extends over a height, measured from the intrados, which measures up to approximately one third of the height of the straight section of the tube.

3. The heat exchanger according to claim 1, wherein a gap between two adjacent turns, measured where the shoulder(s) are located, is wider than a gap between two adjacent turns, measured where there is no shoulder.

4. The heat exchanger according to claim 1, wherein a discoid deflector is mounted inside the helical winding in a gas-tight manner, wherein the discoid deflector provides inside the casing, a condensation chamber which extends between the discoid deflector and a bottom of the casing and the combustion chamber which extends between the discoid deflector and a facade of the casing on which a door carrying said hot gas supply and/or production means is mounted and wherein the shoulder is formed exclusively on the tube(s) or a tube portion which is positioned in the combustion chamber.

5. The heat exchanger according to claim 1, wherein the interstice between the adjacent turns is calibrated using the protruding elements, and wherein each protruding element is formed on a part of the front face and/or of the rear face which does not comprise the shoulder.

6. The heat exchanger according to claim 1, wherein the interstice between the adjacent turns is calibrated using the protruding elements, wherein the protruding elements and the shoulder are formed on opposite faces of the tube and wherein the protruding elements are bearing against a portion of the face of the tube which does not comprise the shoulder.

7. The heat exchanger according to claim 1, wherein the tube is hydroformed.

8. The heat exchanger according to claim 1, wherein the fluid to be heated is water.

9. The heat exchanger according to claim 1, wherein the protruding elements are bosses.

10. The heat exchanger according to claim 1, wherein the means for producing hot gases inside the casing are a gas burner or an oil burner.

11. The heat exchanger according to claim 1, wherein a facade is fixed to the front of the casing, wherein the facade comprises a central opening obturated by a door and wherein the means for supplying hot gases inside the casing comprise a burner disposed outside the heat exchanger and a fan fixed on the door.

* * * * *